US009199811B2

(12) United States Patent
Maruyama

(10) Patent No.: US 9,199,811 B2
(45) Date of Patent: Dec. 1, 2015

(54) SHEET CONVEYING DEVICE AND IMAGE FORMING APPARATUS INCLUDING THE SHEET CONVEYING DEVICE

(71) Applicant: KYOCERA Document Solutions Inc., Osaka-shi, Osaka (JP)

(72) Inventor: Kei Maruyama, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/493,175

(22) Filed: Sep. 22, 2014

(65) Prior Publication Data

US 2015/0084277 A1 Mar. 26, 2015

(30) Foreign Application Priority Data

Sep. 25, 2013 (JP) ..... 2013-198869

(51) Int. Cl.

| | |
|---|---|
| ***B65H 5/06*** | (2006.01) |
| ***B65H 1/04*** | (2006.01) |
| ***G03G 21/16*** | (2006.01) |

(52) U.S. Cl.

CPC ..... *B65H 5/062* (2013.01); *B65H 1/04* (2013.01); *G03G 21/1633* (2013.01); *G03G 21/1647* (2013.01); *B65H 2402/10* (2013.01); *B65H 2402/441* (2013.01); *B65H 2402/61* (2013.01); *B65H 2402/62* (2013.01); *B65H 2402/64* (2013.01); *B65H 2404/611* (2013.01); *B65H 2405/325* (2013.01); *B65H 2405/332* (2013.01); *B65H 2801/06* (2013.01); *G03G 2221/1654* (2013.01)

(58) Field of Classification Search

CPC ..... B65H 5/062; B65H 29/125; B65H 2402/441; B65H 2402/45; B65H 2402/64; B65H 2404/144

See application file for complete search history.

(56) References Cited

U.S. PATENT DOCUMENTS

2012/0074643 A1* 3/2012 Imura ..... 271/225
2013/0264769 A1* 10/2013 Sugizaki ..... 271/264

FOREIGN PATENT DOCUMENTS

JP 07179234 A 7/1995
JP 11321048 A 11/1999

* cited by examiner

*Primary Examiner* — David H Bollinger
(74) *Attorney, Agent, or Firm* — Alleman Hall McCoy Russell & Tuttle LLP

(57) ABSTRACT

A sheet feed device of an image forming apparatus includes an inside cover and a lock mechanism for locking the inside cover to a housing. The lock mechanism includes a locking member and a locked member. When the inside cover is operated in a closing direction toward a closing position, the locking member abuts the locked member. At this time, a driven roller is in no contact with a conveying roller until a projection of the locking member climbs over an apex of the locked member. After the inside cover is further operated toward the closing position and the projection climbs over the apex, the driven roller contacts the conveying roller.

7 Claims, 10 Drawing Sheets

SHEET CONVEYING DEVICE AND IMAGE FORMING APPARATUS INCLUDING THE SHEET CONVEYING DEVICE

INCORPORATION BY REFERENCE

This application is based upon and claims the benefit of priority from the corresponding Japanese Patent Application No. 2013-198869 filed on Sep. 25, 2013, the entire contents of which are incorporated herein by reference.

BACKGROUND

The present disclosure relates to a sheet conveying device for conveying a sheet member, relates in particular to a sheet conveying device including an opening/closing member in a side of the device main body, wherein the opening/closing member can be opened and closed and constitutes a conveyance guide of a conveyance path, and relates to an image forming apparatus including the sheet conveying device.

A conventional image forming apparatus such as a copier or a printer, includes a sheet conveying device for extracting a sheet member (print sheet) housed in a sheet feed cassette, and conveying it. The sheet feed device includes a rotating roller that contacts the sheet member. A rotational driving force of a direction is transmitted to the rotating roller from a motor or the like, thereby the sheet member is conveyed along a conveyance path formed inside the image forming apparatus. In this kind of image forming apparatus, a side cover is provided to expose the conveyance path. For example, a typical image forming apparatus includes a cover that is rotatably supported, with its lower end as a fulcrum. With such a side cover provided, when a jamming of a sheet member occurs in the conveyance path, the user can open the side cover to expose the conveyance path, and easily remove the sheet member from the conveyance path.

SUMMARY

A sheet conveying device according to an aspect of the present disclosure includes a device main body, an opening/closing member, and a lock mechanism. The device main body includes, inside thereof, a first conveying roller. The opening/closing member is supported by a side of the device main body so as to be openable and closable with one end of the opening/closing member as a fulcrum. The opening/closing member includes a second conveying roller which forms a pair of conveying rollers together with the first conveying roller while abutting the first conveying roller when the opening/closing member is at a closing position with respect to the side. The opening/closing member, at the closing position, constitutes a conveying guide of a conveyance path in which a sheet member is conveyed. The lock mechanism locks the opening/closing member, at the closing position, to the device main body. The lock mechanism includes an engaged projection, an engaging projection, and an elastic supporting portion. The engaged projection is provided on an inner wall surface of the device main body and projects toward the opening/closing member, wherein the inner wall surface is perpendicular to the side. The engaged projection projects toward a facing surface of the opening/closing member that faces the inner wall surface when the opening/closing member is at the closing position. The engaging projection is provided on the facing surface, projects toward the inner wall surface and is configured to engage with the engaged projection when the opening/closing member is at the closing position. The elastic supporting portion is configured to support either the engaged projection or the engaging projection in such a manner that the engaged projection or the engaging projection can be displaced between a projection position and a predetermined retreat position in a projecting direction. The elastic supporting portion biases the engaged projection or the engaging projection toward the projection position by an elastic force thereof. During a closing process in which the opening/closing member is operated in a closing direction toward the closing position, the second conveying roller is in no contact with the first conveying roller until the engaging projection abuts the engaged projection to cause the engaged projection or the engaging projection to be retreated, and climbs over the engaged projection, and the second conveying roller contacts the first conveying roller at any point within a period after the engaging projection climbs over the engaged projection and before the engaging projection reaches the closing position.

An image forming apparatus according to another aspect of the present disclosure includes the above-described sheet conveying device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 6A shows the closing position where the outside cover and the inside cover are closed with respect to the housing; and FIG. 6B shows the state where the outside cover and the inside cover are rotationally moved slightly from the closing position.

FIG. 7A shows the state where the engagement between the outside cover and the inside cover is released; and FIG. 7B shows the opening position where the outside cover and the inside cover are completely opened with respect to the housing.

DETAILED DESCRIPTION

Figure 1:
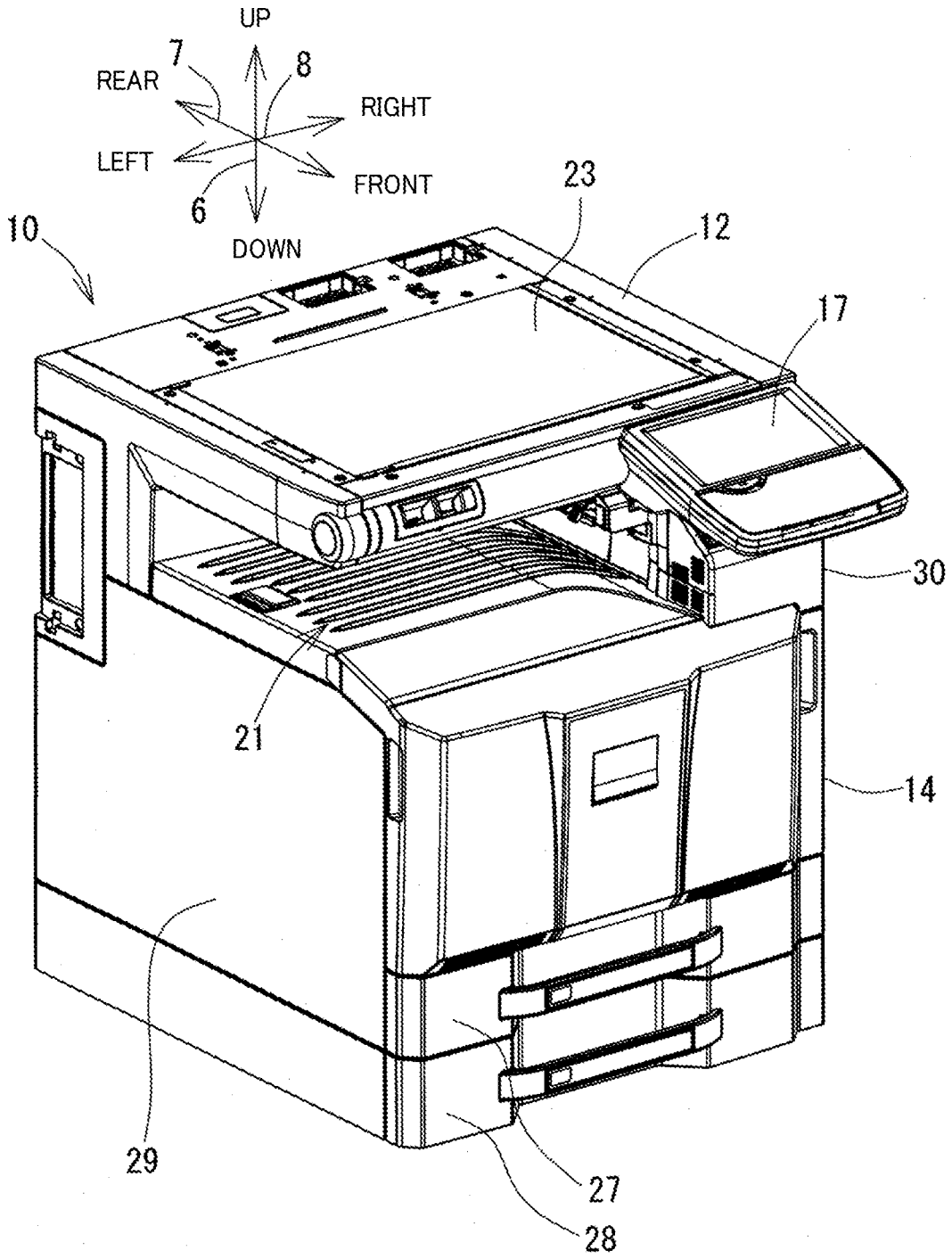
FIG. 1 is a perspective view showing the configuration of the image forming apparatus in the embodiment of the present disclosure.

The following describes, with reference to the drawings, sheet feed devices 27, 28 according to an embodiment of the present disclosure and an image forming apparatus 10 including the sheet feed devices 27, 28.

It is noted that for the sake of explanation, an up-down direction 6 is defined as the vertical direction in the state (state shown in FIG. 1) where the image forming apparatus 10 is installed on a flat surface. In addition, a front-rear direction 7 is defined on the supposition that a surface on which an operation display panel 17 is provided is the front surface (front side). Furthermore, a left-right direction 8 is defined based on the front surface of the image forming apparatus 10. It is noted that embodiments described in the following are merely concrete examples of the present disclosure, and are not intended to limit the technical scope of the present disclosure.

Figure 2:
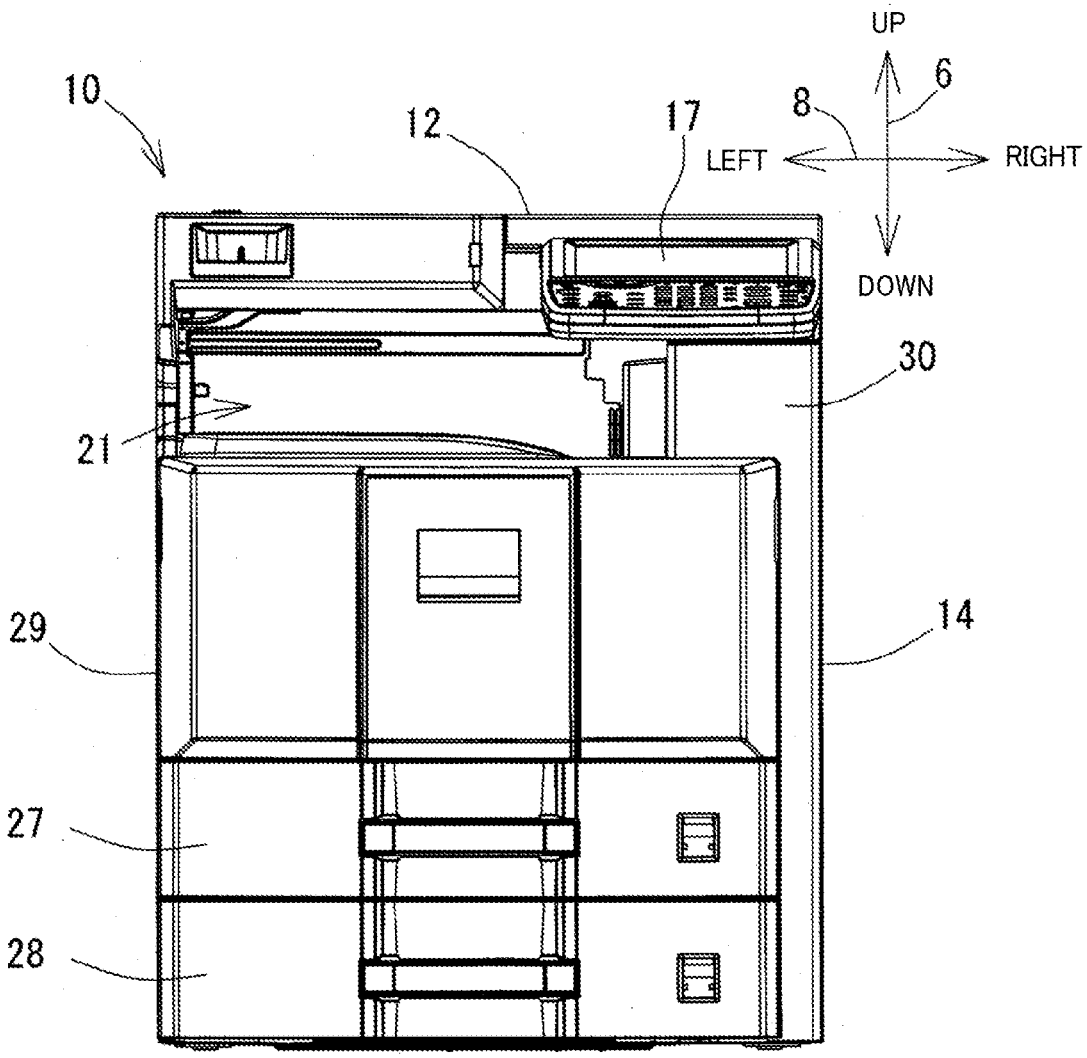
FIG. 2 is a front view showing the configuration of the image forming apparatus of FIG. 1.

First, an outlined configuration of the image forming apparatus 10 will be described with reference to FIGS. 1 through 3. As shown in FIG. 1, the image forming apparatus 10 is a so-called "in-body discharge type" multifunction peripheral, and has various functions such as a printer, a copier, a facsimile, a scanner, and the like. The image forming apparatus 10 forms an image of an input image onto a print sheet P (an example of the sheet member of the present disclosure) by using a print material such as toner. Note that the image forming apparatus 10 is not limited to a multifunction peripheral, and the present disclosure is also applicable to a specialized device such as a printer, a copier, a facsimile or the like.

The image forming apparatus 10 includes an image reading portion 12 and an image forming portion 14. The image reading portion 12 performs a process of reading an image from a document sheet, and is provided in the upper portion of the image forming apparatus 10. The image forming portion 14 performs a process of forming an image based on the electrophotography, and is disposed below the image reading portion 12. The image forming portion 14 includes two sheet feed devices 27 and 28 that are arranged as two tiers in the vertical direction. The sheet feed device 27, the upper one of the two sheet feed devices, is integrally formed with a housing 29 in the lowest portion of the image forming portion 14. The sheet feed device 28, the lower one of the two sheet feed devices, is extension-type and is attached to the bottom surface of the housing 29 of the image forming portion 14 as an option device. The sheet feed device 28 is configured to be attachable/detachable to/from the bottom surface of the housing 29. In addition, a paper sheet discharge portion 30 is provided on the right side of the image forming portion 14. It is noted that the image forming method of the image forming portion 14 is not limited to the electrophotography, but may be an inkjet recording method or other recording or printing methods.

Above the image forming portion 14, a sheet discharge space 21, into which print sheets are discharged, is provided. The paper sheet discharge portion 30 is provided such that it couples the image forming portion 14 with the image reading portion 12, with the sheet discharge space 21 formed between the image forming portion 14 and the image reading portion 12. In the present embodiment, as shown in FIG. 1, the front side and the left side of the sheet discharge space 21 are opened. In addition, the rear side and the right side of the sheet discharge space 21 are not opened. The rear side is closed, and on the right side, the paper sheet discharge portion 30 is provided.

As shown in FIG. 1, the image reading portion 12 includes a document sheet placing table 23. When the image forming apparatus 10 functions as a copier, a document sheet is set on the document sheet placing table 23, and when the image forming apparatus 10 functions as a copier, a document sheet is set on the document sheet placing table 23, and after a document sheet cover 24 (see FIG. 3) is closed, a copy start instruction is input from an operation display panel 17. This causes the image reading portion 12 to start the reading operation to read the image data of the document sheet. The read image data is sent to the image forming portion 14. It is noted that in FIGS. 1 and 2, the document sheet cover 24 of the image reading portion 12 is omitted.

Figure 3:
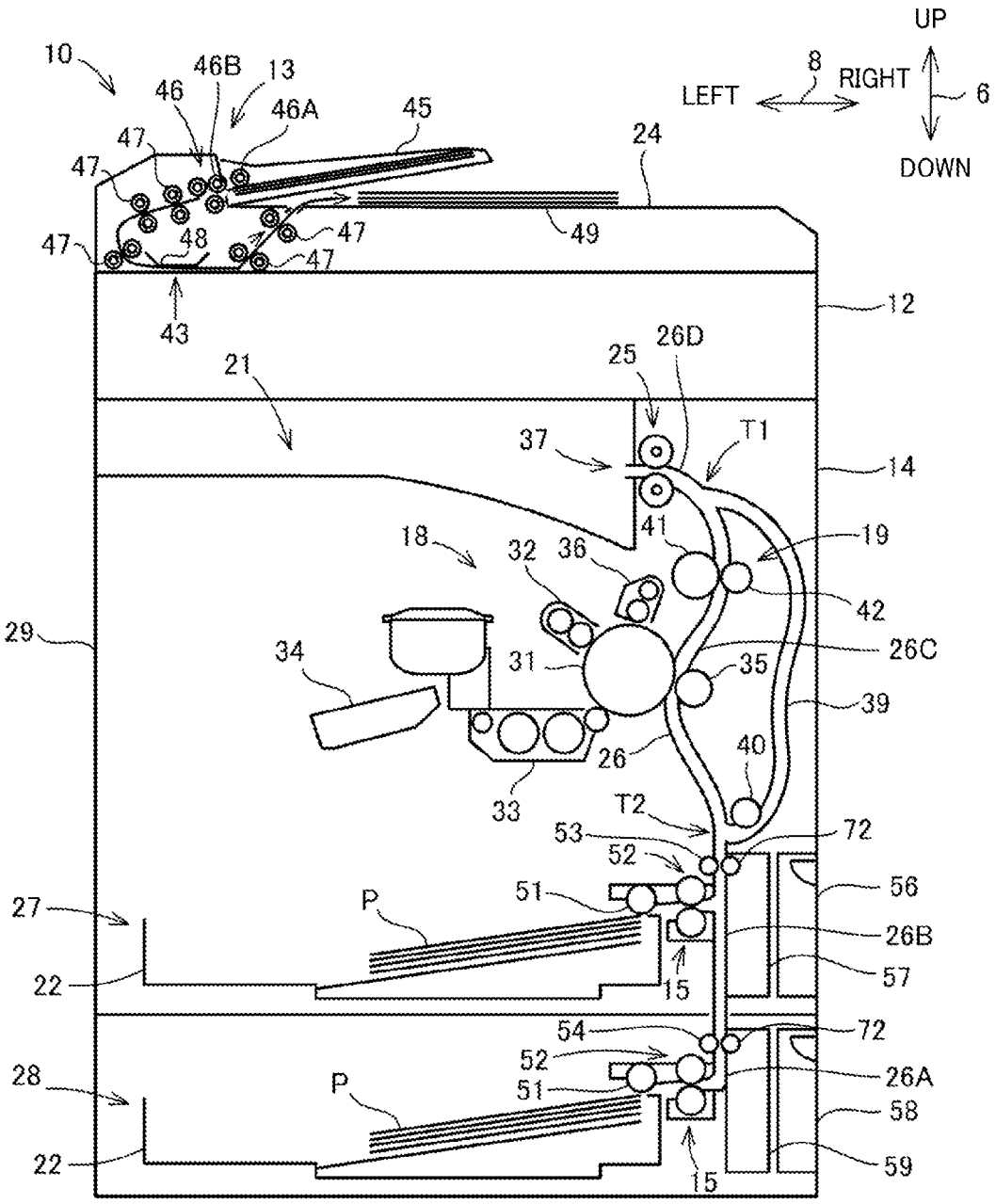
FIG. 3 is a schematic view showing the internal configuration of the image forming apparatus of FIG. 1.

In addition, as shown in FIG. 3, the image reading portion 12 includes an ADF 13. The ADF 13 is provided in the document sheet cover 24. The ADF 13 is an automatic document sheet feeding device and includes a document sheet tray 45, a conveying mechanism 46, a plurality of conveying rollers 47, a paper sheet pressing 48, a sheet discharge portion 49, and the like. The ADF 13 drives motors (not shown) to drive the conveying mechanism 46 and the conveying rollers 47, thereby causing a document sheet set on the document sheet tray 45 to pass a reading position 43 provided on the document sheet placing table 23, and to be conveyed to the sheet discharge portion 49. The conveying mechanism 46 includes a feeding roller 46A and a conveying roller 46B. The feeding roller 46A feeds the document sheet, and the conveying roller 46B conveys the document sheet fed by the feeding roller 46A. The document sheet is fed from the document sheet tray 45 by the feeding roller 46A, and is conveyed by the conveying roller 46B toward the downstream side in the conveying direction. The document sheet is further conveyed by a conveying roller 47 that is provided on the downstream side in the conveying direction. The image of the document sheet is read by the image reading portion 12 when the document sheet passes the reading position 43 during the document sheet conveying process performed by the ADF 13.

The image forming portion 14 forms an image on a print sheet P based on the image data which has been read by the image reading portion 12 or input from the outside, wherein the print sheet P has a specific size such as A-size or B-size. In the present embodiment, as described below, the image forming portion 14 can discharge the print sheet P, on one side of which an image has been formed, into a sheet discharge space 21, or switch back and send the print sheet P into a reverse conveyance path 39 so that an image can be formed on the reverse side of the print sheet P.

As shown in FIG. 3, the image forming portion 14 mainly includes sheet feed devices 27, 28, an image transfer portion 18 that is based on the electrophotography, a fixing portion 19, a control portion (not shown) for totally controlling the image forming portion 14, or the like. That is, the image forming apparatus 10 includes the sheet feed devices 27, 28. In addition, the image forming portion 14 includes a conveying motor and a discharge motor (both not shown). These portions are provided inside the housing 29 that constitutes the outer frame cover, the internal frame and the like of the image forming portion 14. The sheet feed devices 27, 28 are an example of the sheet conveying device of the present disclosure.

The sheet feed devices 27, 28 convey the sheet member to the image transfer portion 18. Each of the sheet feed devices 27, 28 includes a paper sheet housing portion 22 that is in the shape of a tray, and a conveying mechanism 15. The paper sheet housing portion 22 houses a stack of print sheets P (the print sheets P used for image formation) on which images are to be formed by the image transfer portion 18. The conveying mechanism 15 picks up and conveys, one by one, the print sheets P housed in the paper sheet housing portion 22. The conveying mechanism 15 is provided on the upper side of the right-end part of the paper sheet housing portion 22. The conveying mechanism 15 includes a feeding roller 51 and a pair of conveying rollers 52. When an instruction to convey a print sheet P is input into the image forming apparatus 10, the conveying motor is driven and rotated. This causes the feeding roller 51 and the pair of conveying rollers 52 to rotate. The print sheet P is fed from the paper sheet housing portion 22 by the feeding roller 51, and is conveyed toward the downstream side in the conveying direction by the pair of conveying rollers 52.

As shown in FIG. 3, in the image forming portion 14, a vertical conveyance path 26 is formed to extend upward from the pair of conveying rollers 52. The vertical conveyance path 26 is formed in the right-side portion of the housing 29, and extends in the up-down direction 6 along the right side surface. In the following description, the vertical conveyance path 26 is divided into a first conveyance path 26A, a second conveyance path 26B, a third conveyance path 26C, and a fourth conveyance path 26D. The first conveyance path 26A is formed in the sheet feed device 28. The second conveyance path 26B is formed in the sheet feed device 27. The third conveyance path 26C is formed in a section extending from a merge point T2, which is described below and is near the end of the second conveyance path 26B, to a branch point T1 which is described below. The fourth conveyance path 26D is formed in a section extending from the branch point T1 to the sheet discharge space 21.

Figure 4:
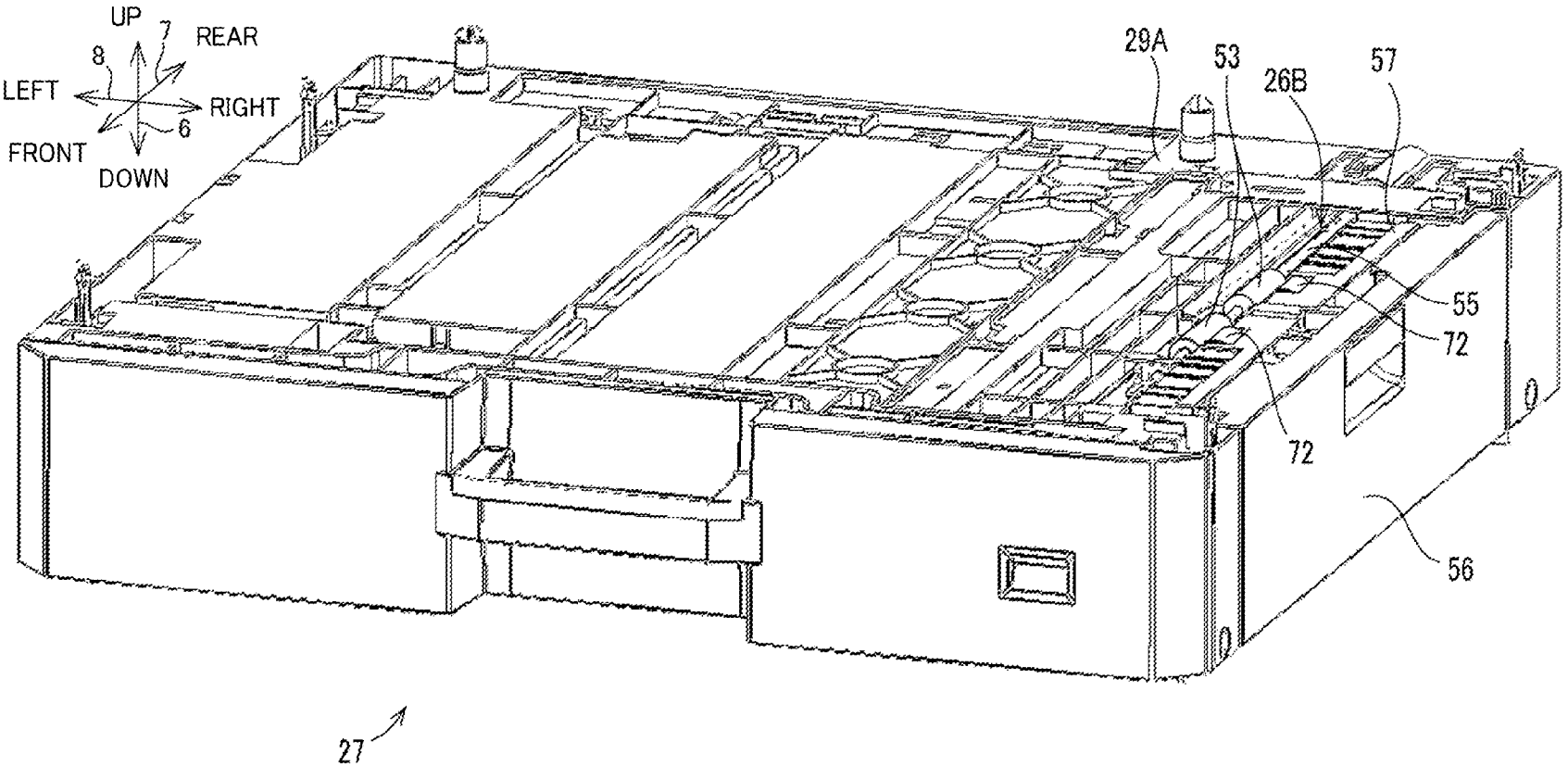
FIG. 4 is a perspective view showing the configuration of the sheet feed device included in the image forming apparatus of FIG. 1.
Figure 5:
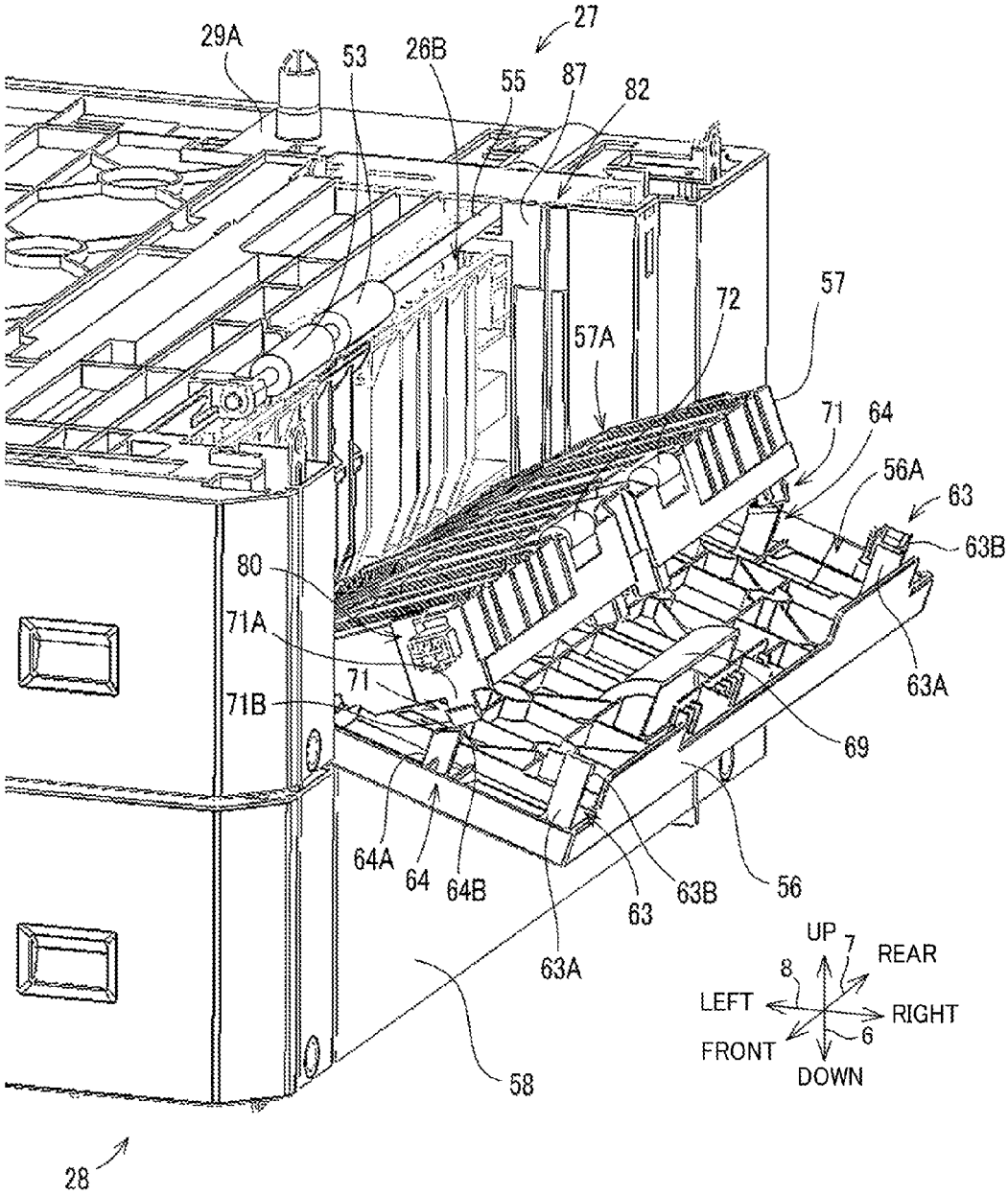
FIG. 5 is a perspective view showing the configuration of the outside cover and the inside cover included in the sheet feed device of FIG. 4.

As shown in FIGS. 4 and 5, the sheet feed device 27 includes conveying rollers 53 (an example of the first conveying roller of the present disclosure). The conveying rollers 53 are driving rollers that are rotated by receiving a rotational driving force transmitted from the conveying motor. Elastic members are attached to the roller surfaces of the conveying rollers 53, wherein the elastic members are made of rubber or the like having a high sliding friction. A rotational shaft 55 of the conveying rollers 53 extends in the rear direction, and the rotational driving force of the conveying motor is input to a gear (not shown) provided in the rear end of the rotational shaft 55. The conveying rollers 53 are disposed in the vicinity of the upper end of the second conveyance path 26B, and are rotatably supported by the housing 29A. The conveying rollers 53 are supported in the state where their roller surfaces are exposed to the second conveyance path 26B. When an inside cover 57 described below is at the closing position (see FIGS. 3 and 4) and is in the state where it is locked by lock mechanisms 80, the conveying rollers 53 abut driven rollers 72 (an example of the second conveying roller of the present disclosure). The driven rollers 72 are rotating rollers or the like included in the inside cover 57. In the present embodiment, two conveying rollers 53 are provided at the center of the upper surface of the housing 29A in the front-rear direction 7. When the conveying rollers 53 are rotated by the conveying motor, the print sheet P having been conveyed to the second conveyance path 26B by the conveying mechanism 15 is conveyed upward while it is nipped by the conveying rollers 53 and the driven rollers 72. It is noted that, in the sheet feed device 28 too, conveying rollers 54 (an example of the first conveying roller of the present disclosure) similar to the conveying rollers 53 are rotatably supported in the vicinity of the upper end of the first conveyance path 26A. The conveying rollers 54 have the same configuration as the conveying rollers 53, and description thereof is omitted here.

Furthermore, the sheet feed device 27 includes an outside cover 56 and an inside cover 57. The inside cover 57 is an example of the opening/closing member of the present disclosure. The outside cover 56 and the inside cover 57 are provided at the right end of the sheet feed device 27. The outside cover 56 and the inside cover 57 are rotatably supported by the housing 29. In the present embodiment, when the outside cover 56 is opened from the closing position shown in FIG. 3, the inside cover 57 is opened in conjunction with the opening operation of the outside cover 56. This causes the second conveyance path 26B in the sheet feed device 27 to be exposed. It is noted that the sheet feed device 28 also includes an outside cover 58 and an inside cover 59 in a similar manner to the sheet feed device 27. The configuration of the outside cover 56 and the inside cover 57 is described below.

Above the sheet feed device 27, the image transfer portion 18 is provided. The image transfer portion 18 performs an image transfer process onto the print sheet P conveyed from the sheet feed devices 27, 28. Specifically, the image transfer portion 18 transfers, based on the input image data, a toner image onto the print sheet P using a print material such as toner. As shown in FIG. 3, the image transfer portion 18 includes a photoconductor drum 31, a charging portion 32, a developing portion 33, an LSU (Laser Scanning Unit) 34, a transfer roller 35, and a cleaning portion 36.

The photoconductor drum 31 is provided on the left side of the third conveyance path 26C. When the image forming operation is started, the charging portion 32 charges the surface of the photoconductor drum 31 uniformly into a certain potential. In addition, the LSU 34 scans the photoconductor drum 31 by laser light based on the image data. This results in an electrostatic latent image formed on the photoconductor drum 31. The developing portion 33 then causes the toner to adhere to the electrostatic latent image, and a toner image is formed on the photoconductor drum 31. The transfer roller 35 is provided on the right side of the third conveyance path 26C, and is disposed to face the photoconductor drum 31 across the third conveyance path 26C. When the print sheet P conveyed in the third conveyance path 26C passes through a nip portion between the transfer roller 35 and the photoconductor drum 31, the toner image is tranferred onto the print sheet P by the transfer roller 35. The print sheet P with the toner image transferred thereon is conveyed in the third conveyance path 26C to the fixing portion 19 that is disposed on the downstream side of (i.e., above) the image transfer portion 18 in the conveyance direction of the print sheet P.

The fixing portion 19 fixes the toner image transferred on the print sheet P to the print sheet P by heat. The fixing portion 19 includes a heating roller 41 and a pressure roller 42. The pressure roller 42 is biased toward the heating roller 41 by an elastic member such as a spring. As a result, the pressure roller 42 is brought into pressure contact with the heating roller 41. During the fixing operation, the heating roller 41 is heated to a high temperature by a heating means such as a heater. When the print sheet P passes through the fixing portion 19, the toner forming the toner image is heated and fused by the heating roller 41, and the print sheet P is pressed by the pressure roller 42. As a result, the toner is fixed to the print sheet P by the fixing portion 19. That is, the toner image is fixed to the print sheet P, and an image is formed on the print sheet P.

At the end of the fourth conveyance path 26D of the vertical conveyance path 26, a paper sheet discharge outlet 37, through which the print sheet P is discharged, is provided. A section near the end of the vertical conveyance path 26, more specifically, the fourth conveyance path 26D extending from the branch point T1 to the paper sheet discharge outlet 37 is curved from the vertical direction to the horizontal direction, wherein the branch point T1 is positioned on the downstream side of the fixing portion 19. In the vicinity of the paper sheet discharge outlet 37, a pair of discharge rollers 25, which are configured to be rotated in dual directions by a discharge motor (not shown), are provided. The print sheet P having been passed through the fixing portion 19 and conveyed to the fourth conveyance path 26D is conveyed from the paper sheet discharge outlet 37 toward the sheet discharge space 21 by the pair of discharge rollers 25 that are rotated in the forward direction by the discharge motor.

When the single side printing is performed in the image forming portion 14, a print sheet P, with a toner image transferred on a side thereof by the image transfer portion 18, is passed through the fixing portion 19, conveyed in the fourth conveyance path 26D, and discharged from the paper sheet discharge outlet 37 outward.

On the other hand, when the double side printing is performed in the image forming portion 14, first a print sheet P with an image formed on a side thereof is passed through the fixing portion 19, and then conveyed in the fourth conveyance path 26D in the reverse direction into a reverse conveyance path 39. Specifically, the pair of discharge rollers 25 are stopped in the state where the front end of the print sheet P, with an image formed on a side thereof, is exposed from the paper sheet discharge outlet 37 to outside. At this time, the rear end of the print sheet P is held in the state where it is nipped by the pair of discharge rollers 25 near the paper sheet discharge outlet 37. Then, the pair of discharge rollers 25 are rotated in the reverse direction by the reverse rotation driving of the discharge motor (not shown). This causes the print sheet P to be conveyed in the fourth conveyance path 26D in the reverse direction. That is, the print sheet P is conveyed backward in the fourth conveyance path 26D. As shown in FIG. 3, the reverse conveyance path 39, branched from the fourth conveyance path 26D, is formed in the image forming portion 14. The reverse conveyance path 39 merges with the third conveyance path 26C at the merge point T2, which is positioned on the upstream side in the conveyance direction of the print sheet P when viewed from the image transfer portion 18 side. That is, the reverse conveyance path 39 extends from the branch point T1 to the merge point T2. The reverse conveyance path 39 is formed on the right side of the vertical conveyance path 26 in the housing 29. The reverse conveyance path 39 extends in the up-down direction 6 (vertical direction) to be approximately in parallel with the vertical conveyance path 26.

The print sheet P having been conveyed from the fourth conveyance path 26D into the reverse conveyance path 39 is guided downward in the reverse conveyance path 39. In the reverse conveyance path 39, a conveying roller 40 is provided in the vicinity of the merge point T2. The print sheet P having been guided downward in the reverse conveyance path 39 is sent into the vertical conveyance path 26 again by the conveying roller 40 provided immediately before the merge point T2. The print sheet P is then conveyed in the third conveyance path 26C to the image transfer portion 18 again. In the image transfer portion 18, a side of the print sheet P, on which no image has been formed, is set to face the photoconductor drum 31 again. The print sheet P is then passed through the image transfer portion 18 and the fixing portion 19 in sequence, and an image is formed on the opposite side of the print sheet P on which no image has been formed. Subsequently, the print sheet P with images formed on both sides thereof is conveyed in the fourth conveyance path 26D by the pair of discharge rollers 25 that have been returned to the forward rotation, and then discharged into the sheet discharge space 21 from the paper sheet discharge outlet 37.

Figure 6A:
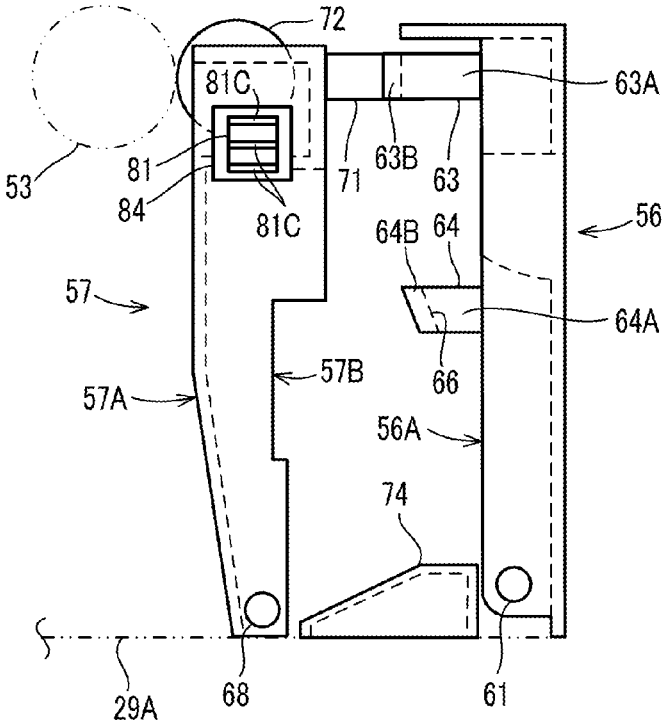
FIGS. 6A and 6B are schematic views showing operation states of the outside cover and the inside cover.
Figure 6B:
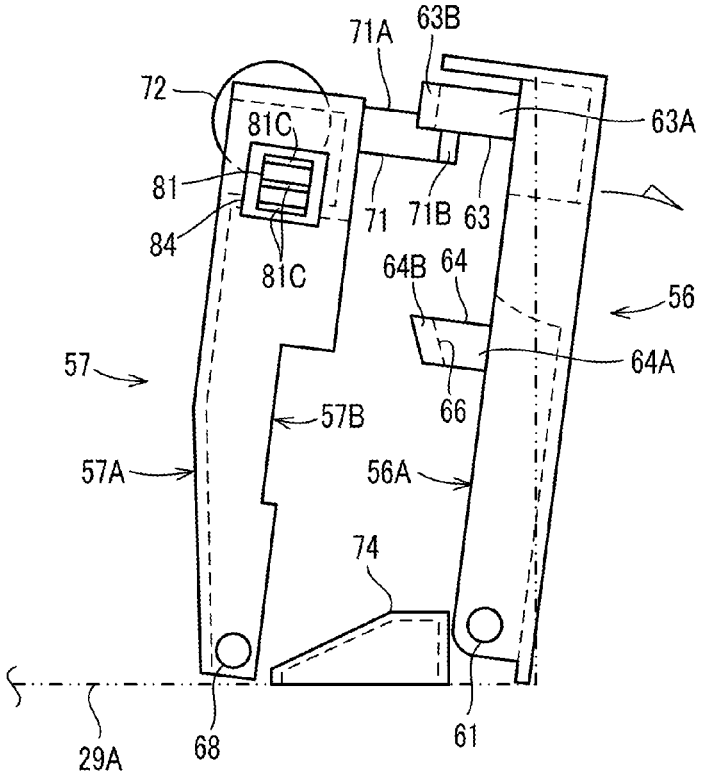
Figure 7A:
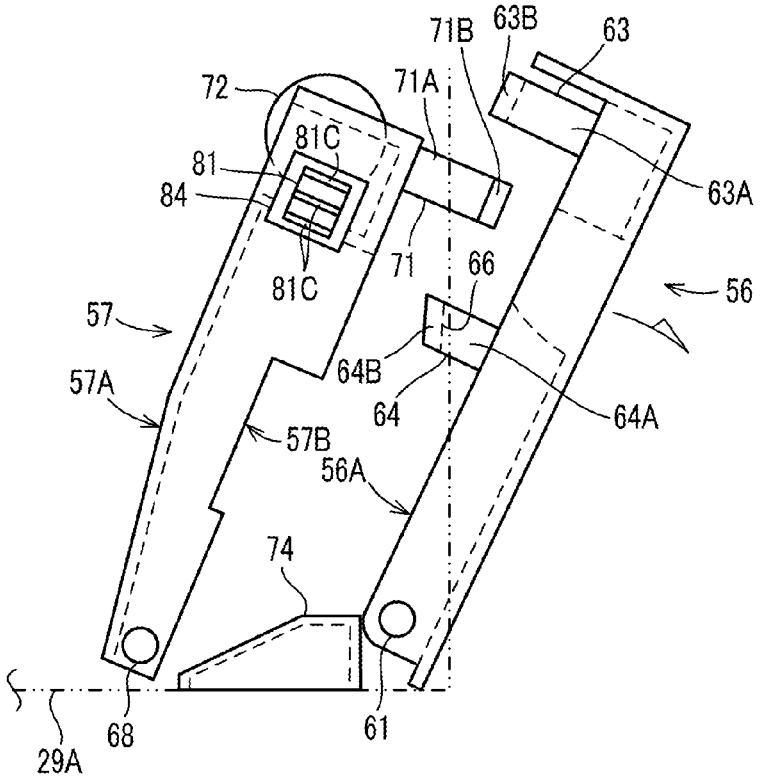
FIGS. 7A and 7B are schematic views showing operation states of the outside cover and the inside cover.
Figure 7B:
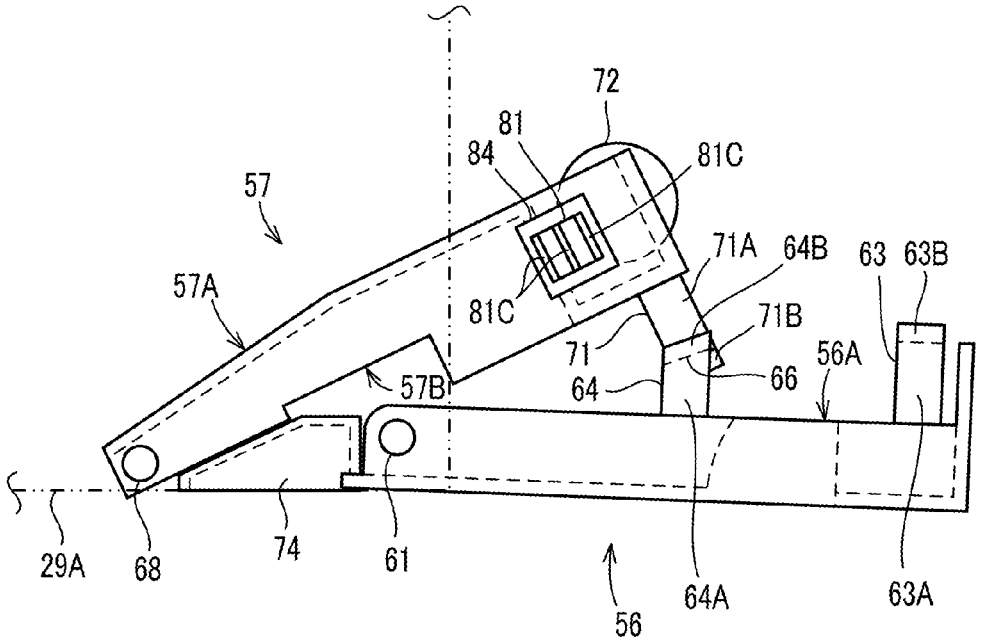

Next, the configuration of the outside cover 56 and the inside cover 57 of the sheet feed device 27 is described with reference to FIGS. 3 through 6B. It is noted that the outside cover 58 and the inside cover 59 of the sheet feed device 28 (see FIG. 3) have the same configuration as the outside cover 56 and the inside cover 57 of the sheet feed device 27. As a result, the same reference numbers assigned to the outside cover 56 and the inside cover 57 of the sheet feed device 27 are assigned to the outside cover 58 and the inside cover 59 of the sheet feed device 28, and detailed description thereof is omitted. Here, FIG. 4 is a perspective view showing the configuration of the sheet feed device 27 extracted from the image forming apparatus 10. FIG. 5 is a perspective view showing the configuration of the sheet feed devices 27, 28 extracted from the image forming apparatus 10. FIGS. 6A and 6B are schematic views showing the configuration and operation of the outside cover 56 and the inside cover 57, with the front-side surfaces of the outside cover 56 and the inside cover 57 being shown. It is noted that, in FIGS. 6A and 6B, a specific drawing of a housing 29A of the sheet feed device 27 is omitted, and only part of the outer frame of the housing 29A is shown by the two-dot chain line.

As shown in FIG. 4, the outside cover 56 and the inside cover 57 are provided at the right end of the sheet feed device 27. The outside cover 56 and the outside cover 58 are both attached to the housing 29A of the sheet feed device 27. Here, the housing 29A of the sheet feed device 27 is a part of the housing 29 of the image forming apparatus 10, and is a part of the housing 29 corresponding to the sheet feed device 27.

The outside cover 56 constitutes the right side of the sheet feed device 27, and as shown in FIG. 4, is formed in the shape of a rectangle that is long in the front-rear direction 7 and short in the up-down direction 6. The outside cover 56 is formed by the injection molding of synthetic resin. The outside cover 56 is rotatably supported by the housing 29A, with the lower end of the outside cover 56 as a fulcrum. The outside cover 56 is supported to be openable and closable with respect to the right side of the sheet feed device 27. Specifically, the outside cover 56 is supported by the housing 29A such that it can be positioned at a closing position (the position shown in FIGS. 3 and 4) where the right side of the sheet feed device 27 is closed, and at an opening position (the position shown in FIG. 5) where the right side of the sheet feed device 27 is opened. Rotational shafts 61 as the fulcrum are provided at the lower end of the outside cover 56 at the closing position (see FIGS. 6A and 6B). The rotational shafts 61 are provided respectively at both ends of the outside cover 56 in the front-rear direction 7. The rotational shafts 61 are rotatably supported by the housing 29A.

As shown in FIG. 5, the outside cover 56 includes first locking pieces 63 and second locking pieces 64. The first locking pieces 63 and the second locking pieces 64 are respectively coupled with locked pieces 71 (which are described below) included in the inside cover 57 during the opening/closing operation of the outside cover 56. When the first locking pieces 63 and the second locking pieces 64 are locked to the locked pieces 71, the outside cover 56 and the inside cover 57 can be opened and closed in conjunction with each other. It is noted that the first locking pieces 63, second locking pieces 64, and locked pieces 71 are an example of the interlocking member of the present disclosure.

Two first locking pieces 63 are integrally formed with the outside cover 56. Each first locking piece 63 is formed on an inner surface 56A of the outside cover 56. The inner surface 56A faces the inside cover 57 when the outside cover 56 is at the closing position. The first locking pieces 63 are respectively formed at both ends of the inner surface 56A in the front-rear direction 7. More specifically, the first locking pieces 63 are formed near the edge of the inner surface 56A that is farthest from the rotational shafts 61. Each first locking piece 63 includes an arm 63A and a locking claw 63B. The arm 63A is projecting vertically from the inner surface 56A. The locking claw 63B is in a shape of a hook bending from the tip of the arm 63A toward inside in the axis direction (matching the front-rear direction 7) of the rotational shafts 61. The locking claw 63B is coupled with a locking claw 71B of a locked piece 71 that are described below.

Furthermore, two second locking pieces 64 are integrally formed with the outside cover 56. Each second locking piece 64 is formed on the inner surface 56A of the outside cover 56. The second locking pieces 64 are formed at both ends of the inner surface 56A in the front-rear direction 7. More specifically, the second locking pieces 64 are formed to be between the rotational shafts 61 and the first locking pieces 63 in the inner surface 56A. In other words, the second locking pieces 64 are formed at a position that is more on the rotational shafts 61 side than a position at which the first locking pieces 63 are formed in the inner surface 56A. Each second locking piece 64 includes an arm 64A and a locking claw 64B. The arm 64A is projecting vertically from the inner surface 56A. The locking claw 64B is in a shape of a hook bending from the tip of the arm 64A toward inside in the axis direction (matching the front-rear direction 7) of the rotational shafts 61. The locking claw 64B is coupled with a locking claw 71B of a locked piece 71 that are described below.

As shown in FIG. 5, the first locking pieces 63 are formed to be longer than the second locking pieces 64. The lengths of the first locking pieces 63 and the second locking pieces 64 in the projecting direction are elements that are determined based on: the positional relationship between the outside cover 56 and the inside cover 57; the angle of inclination of the outside cover 56 when the second locking pieces 64 are locked to the locked pieces 71; or the like.

As shown in FIGS. 5, 6A and 6B, each locking claw 64B of the second locking pieces 64 has an inclined surface 66 that is inclined in a predetermined direction. The inclined surface 66 is a surface that contacts the locking claw 71B when the locking claw 64B of the second locking piece 64 is locked to the locking claw 71B of the locked piece 71. The inclined surface 66 is inclined toward the rotational shafts 61 with reference to the inner surface 56A of the outside cover 56. As a result, in the space formed by the inclined surface 66 and the inner surface 56A of the outside cover 56, the space on the rotational shafts 61 side is smaller than the space on the first locking pieces 63 side. That is, the first locking pieces 63 side space is larger than the rotational shafts 61 side space.

As shown in FIG. 5, a pressing portion 69 is provided in the inner surface 56A of the outside cover 56. The pressing portion 69 is integrally formed with the outside cover 56. When the outside cover 56 is closed and the right side of the sheet feed device 27 is closed, the pressing portion 69 presses the outer surface 57B of the inside cover 57 and causes the inside cover 57 to be rotationally moved in a direction (closing direction) toward the closing position. The pressing portion 69 is provided in the vicinity of the center of the inner surface 56A, and is projecting vertically from the inner surface 56A. It is noted that the pressing portion 69 is omitted in FIGS. 6A and 6B.

As shown in FIG. 5, the inside cover 57 is formed in the shape of a rectangle that is long in the front-rear direction 7 and short in the up-down direction 6. Similar to the outside cover 56, the inside cover 57 is formed by the injection molding of synthetic resin. The inside cover 57 is disposed more inside of the sheet feed device 27 than the outside cover 56, that is, more inside of the housing 29A. Specifically, as shown in FIG. 3, the inside cover 57 is disposed at a position between the second conveyance path 26B and the outside cover 56. An inner surface 57A of the inside cover 57, which is a surface of the inside cover 57 on the inner side, functions as a guide surface on the right side of the second conveyance path 26B when the inside cover 57 is at the closing position shown in FIGS. 3 and 4. That is, the inside cover 57 being at the closing position constitutes a conveyance guide on the right side of the second conveyance path 26B that extends in the vertical direction (the up-down direction 6). In the present embodiment, the inside cover 57 is supported by the housing 29A so as to be openable and closable such that the second conveyance path 26B can be exposed and closed. When the inside cover 57 is rotationally moved in the opening direction from the closing position (see FIGS. 3 and 4) toward the opening position, the second conveyance path 26B is exposed.

Specifically, the inside cover 57 is supported by the housing 29A such that the inside cover 57 can be rotationally moved between: a closing position (the position shown in FIGS. 3 and 4) where the second conveyance path 26B formed inside the housing 29A is closed; and an opening position (the position shown in FIG. 5) where the second conveyance path 26B is exposed. Rotational shafts 68 as the fulcrum are provided in the lower end of the inside cover 57 at the closing position (see FIGS. 6A and 6B). In the housing 29A, the rotational shafts 68 are provided at approximately the same height as the rotational shafts 61 of the outside cover 56. The rotational shafts 68 are provided respectively at both ends of the inside cover 57 in the front-rear direction 7. The rotational shafts 68 are rotatably supported by the housing 29A.

As shown in FIG. 5, the inside cover 57 includes locked pieces 71. The locked pieces 71 are parts that are to be coupled with the outside cover 56. The locked pieces 71 are selectively locked to and coupled with either the first locking pieces 63 or the second locking pieces 64 of the outside cover 56 during the opening/closing operation of the outside cover 56. In the present embodiment, the locked pieces 71 are coupled with the first locking pieces 63 when the outside cover 56 and the inside cover 57 are both at the closing position shown in FIGS. 3 and 4. Furthermore, the locked pieces 71 are locked to and coupled with the second locking pieces 64 when the outside cover 56 and the inside cover 57 are rotationally moved in the opening direction and have reached the opening position shown in FIG. 5.

Two locked pieces 71 are integrally formed with the inside cover 57. The locked pieces 71 are formed on an outer surface 57B of the inside cover 57. The outer surface 57B (see FIGS. 6A and 6B) is a surface of the inside cover 57 that faces the outside cover 56 when the covers 56 and 57 are at the closing position. Each locked piece 71 includes an arm 71A and a locking claw 71B. The arm 71A is projecting vertically from the outer surface 57B. The locking claw 71B is in a shape of a hook bending from the tip of the arm 71A toward outside in the axis direction (matching the front-rear direction 7) of the rotational shafts 68. The locking claw 71B is locked to a locking claw 63B of a first locking piece 63, or a locking claw 64B of a second locking piece 64.

As shown in FIG. 5, lock mechanisms 80 are provided at both ends of the inside cover 57 in the front-rear direction 7. The lock mechanisms 80 cause the inside cover 57 to be locked (fixed) to the housing 29A when the inside cover 57 is at the closing position. Since the lock mechanisms 80 are provided, the inside cover 57 is held at the closing position with respect to the housing 29A. The configuration of the lock mechanisms 80 is described below.

As shown in FIG. 5, two driven rollers 72 are provided in the inside cover 57. The driven rollers 72 are rotatably supported by the upper end of the inner surface 57A. When the inside cover 57 is at the closing position, the driven rollers 72 abut the roller surfaces of the conveying rollers 53. The conveying rollers 53 and the driven rollers 72 constitute a pair of conveying rollers for conveying the print sheet P. When the conveying rollers 53 are rotated while the conveying rollers 53 are in contact with the driven rollers 72, the driven rollers 72 are driven and rotated by the rotation of the conveying rollers 53.

As shown in FIGS. 6A and 6B, the housing 29A is provided with a supporting portion 74 that supports the inside cover 57. The supporting portion 74, when the inside cover 57 is opened from the closing position and further rotationally moved rightward, abuts the outer surface 57B of the inside cover 57 at a predetermined rotational position, and supports the inside cover 57. That is, the supporting portion 74 restricts the inside cover 57 from being further rotationally moved from the predetermined rotational position. In the present embodiment, the supporting portion 74 supports the inside cover 57 such that the inside cover 57 is held at the rotational position where the locking claw 64B of the second locking piece 64 is locked to the locking claw 71B of the locked piece 71.

The following describes the opening/closing operation of the outside cover 56 and the inside cover 57 configured as described above, with reference to FIGS. 6A through 7B.

When both of the outside cover 56 and the inside cover 57 are at the closing position (see FIG. 6A), the inside cover 57 is held at the closing position by the lock mechanisms 80. At this time, the locking claws 63B of the first locking pieces 63 are not locked to the locking claws 71B of the locked pieces 71, but are disposed at a position having a predetermined distance from the inner side surfaces of the locking claws 71B. When the outside cover 56 is rotationally moved in the opening direction from this position, the locking claws 63B move toward the inner side surfaces of the locking claws 71B and abut the locking claws 71B. That is, the locking claws 63B of the first locking pieces 63 are locked to the locking claws 71B of the locked pieces 71. This causes the locking claws 63B to be coupled with the locking claws 71B in the opening direction. When the outside cover 56 is further rotationally moved in the opening direction from this position, the locking claws 63B bias the locking claws 71B to pull them toward the opening position. That is, when the outside cover 56 is rotationally moved in the opening direction from the closing position toward the opening position, the first locking pieces 63 bias the locked pieces 71 in the opening direction. This generates a pulling force that urges the inside cover 57 to be rotationally moved in the opening direction in conjunction with the outside cover 56. When the inside cover 57 is unlocked from the lock members 80 by this pulling force, the inside cover 57 is rotationally moved in the opening direction in conjunction with the opening operation of the outside cover 56 (see FIG. 6B).

As shown in FIG. 6B, during the process in which the outside cover 56 and the inside cover 57 are rotationally moved from the closing position toward the opening position, the locking claws 71B move downward relative to the locking claws 63B. This movement is caused by the rotational shafts 68 of the inside cover 57 being disposed more inside of the housing 29A than the rotational shafts 61 of the outside cover 56. When the outside cover 56 is further rotationally moved in the opening direction, the locking claws 71B are pulled from under the locking claws 63B, and the engagement between the locking claws 71B and the locking claws 63B is released (see FIG. 7A). That is, when the outside cover 56 is rotationally moved in the opening direction, the first locking pieces 63 bias the locked pieces 71 in the opening direction and cause the inside cover 57 to be rotationally moved in the opening direction, and then are disengaged from the locking claws 71B of the locked pieces 71, and the coupling between the locking claws 63B and the locking claws 71B is released. At this time, the inside cover 57 is inclined outward (toward the opening position), and therefore the inside cover 57 is rotationally moved in the opening direction by the weight of the inside cover 57 itself even if it does not receive the pulling force from the outside cover 56.

When the outside cover 56 is further rotationally moved in the opening direction, during the further rotational movement, the locking claws 71B of the locked pieces 71 gradually approach the second locking pieces 64. Then when the inside cover 57 is rotationally moved and reaches the opening position where the outer surface 57B of the inside cover 57 is supported by the supporting portion 74, the locking claws 71B enter the locking claws 64B of the second locking pieces 64, and the locking claws 71B and the locking claws 64B are locked to each other (see FIG. 7B). This causes the locking claws 71B and the locking claws 64B to be coupled with each other in the opening direction. That is, when the locking claws 63B of the first locking pieces 63 are disengaged from the locking claws 71B of the locked pieces 71, the engagement is released, and then the outside cover 56 is further rotationally moved in the opening direction, and the locking claws 64B of the second locking pieces 64 are locked to and coupled with the locking claws 71B of the locked pieces 71. With this coupling, the outside cover 56 is held at the opening position. In the present embodiment, as described above, each locking claw 64B has the inclined surface 66. As a result, in the space formed by the locking claws 64B and the inner surface 56A of the outside cover 56, the opening, which is farther from the rotational shafts 61, is formed broadened. This makes it easier for the locking claws 71B to enter the locking claws 64B.

With the above-described configuration of the outside cover 56 and the inside cover 57 of the sheet feed device 27, it is possible to open both covers 56, 57 in conjunction with each other by rotationally moving only the outside cover 56 in the opening direction from the state where both the outside cover 56 and the inside cover 57 are at the closing position. In addition, since the locking claws 71B are locked to the locking claws 64B in the state where the inside cover 57 is supported by the supporting portion 74, the outside cover 56 is not rotationally moved unnecessarily. It is noted that, when the outside cover 56 is rotationally moved in the closing direction to close the outside cover 56 and the inside cover 57, the pressing portion 69 of the inner surface 56A of the outside cover 56 abuts the vicinity of the center of the outer surface 57B of the inside cover 57, and presses the inside cover 57 toward the closing position. This causes the outside cover 56 and the inside cover 57 to be rotationally moved in conjunction with each other toward the closing position.

In addition, the outside cover 56 and the inside cover 57 are coupled in conjunction with each other by the first locking pieces 63 and the second locking pieces 64 that are integrally formed with the outside cover 56, and by the locked pieces 71 that are integrally formed with the inside cover 57. Therefore, an independent coupling member is not required, and the cost for the parts can be reduced.

Meanwhile, a conventional image forming apparatus includes typical lock mechanisms which lock the inside cover 57 to the housing 29A. However, when the typical lock mechanisms are applied to the inside cover 57 of the image forming apparatus 10 of the present disclosure, the following problems occur. Specifically, when the driven rollers 72 supported by the inside cover 57 are configured to abut the conveying rollers 53 provided in the second conveyance path 26B, the conveying rollers 53 contact the driven rollers 72 during the process in which the housing 29A is closed by the inside cover 57. In that case, the conveying rollers 53 and the driven rollers 72 respectively receive repulsive forces that repel in the opposite directions. The repulsive forces act in the direction to open the inside cover 57. This might make insufficient the locking of the inside cover 57 by the lock mechanisms 80. For example, in a configuration where typical lock mechanisms are provided at both ends of the inside cover, there may be a case where only a lock mechanism locks the inside cover, and the other lock mechanism does not lock the inside cover. In that case, the inside cover 57 is insufficiently locked at the closing position, and a conveyance failure may occur when the print sheet P is conveyed. It is noted that a sensor may be mounted to detect the opening/closing state of the inside cover 57, and the sensor may be able to detect whether or not the locking by the typical lock mechanisms is sufficient. However, when typical lock mechanisms are provided respectively at both ends of the inside cover 57 in the width direction, and the sensor is mounted to detect the locking state of only a lock mechanism provided at an end of the inside cover, the locking state of the other lock mechanism cannot be detected. In that case, a conveyance failure of the print sheet P may occur due to the detection inability.

The lock mechanisms 80 of the present disclosure, as described below, are configured to ensure the locking of the inside cover 57 to the housing 29A.

Figure 8:
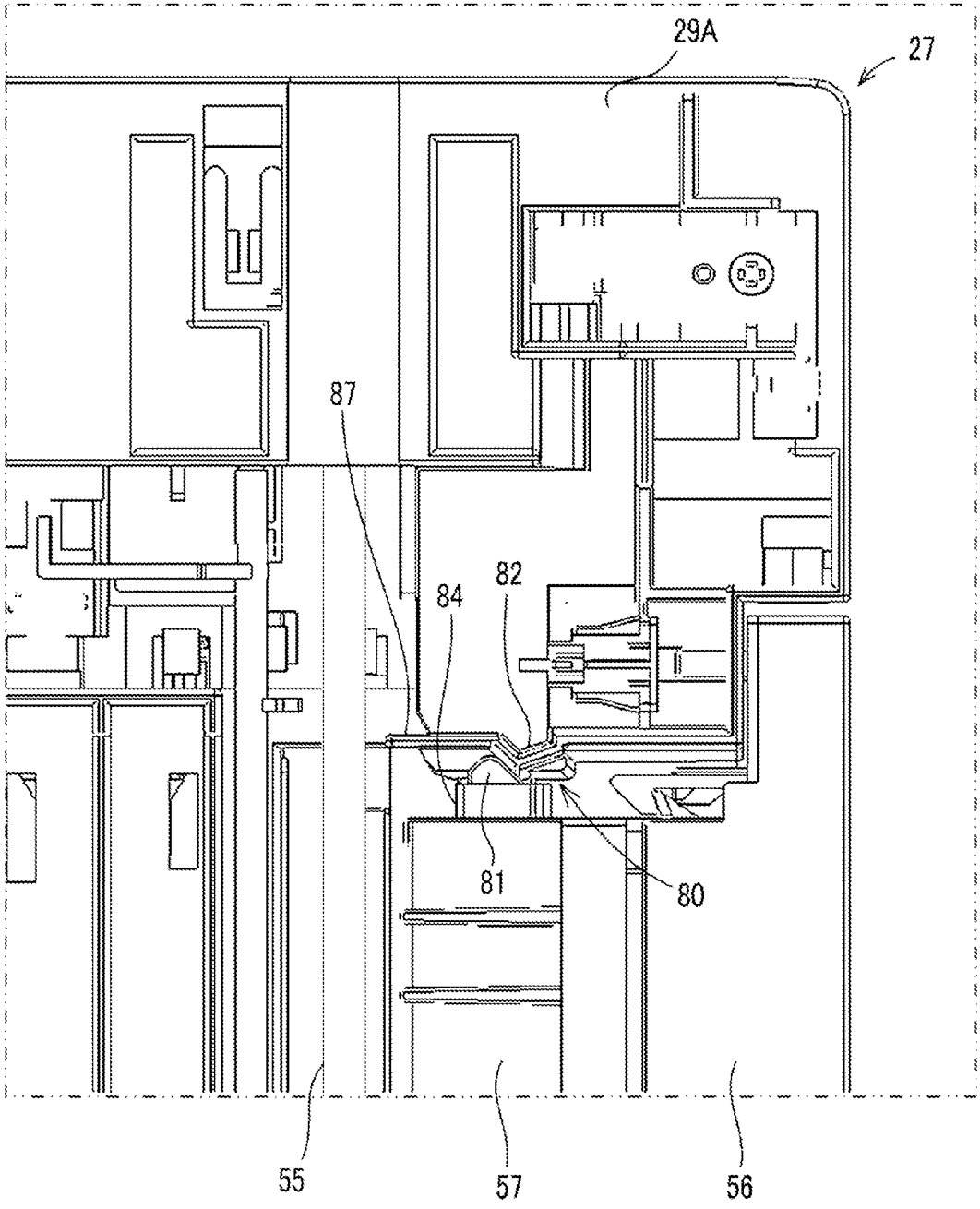
FIG. 8 is a partially enlarged view showing the lock mechanism included in the sheet feed device of FIG. 4.

The following explains the configuration of the lock mechanisms 80 with reference to FIGS. 6A, 6B, and 8 through 10. Here, FIG. 8 is a top view of the sheet feed device 27 showing the peripheral configuration of the lock mechanism 80 provided in the rear side, and shows the state where the inside cover 57 at the closing position is locked (fixed) to the housing 29A. FIG. 9A is a perspective view showing the state where the locking by the lock mechanism 80 is not made, and FIG. 9B is a perspective view showing the state where the locking by the lock mechanism 80 is made.

Figure 9A:
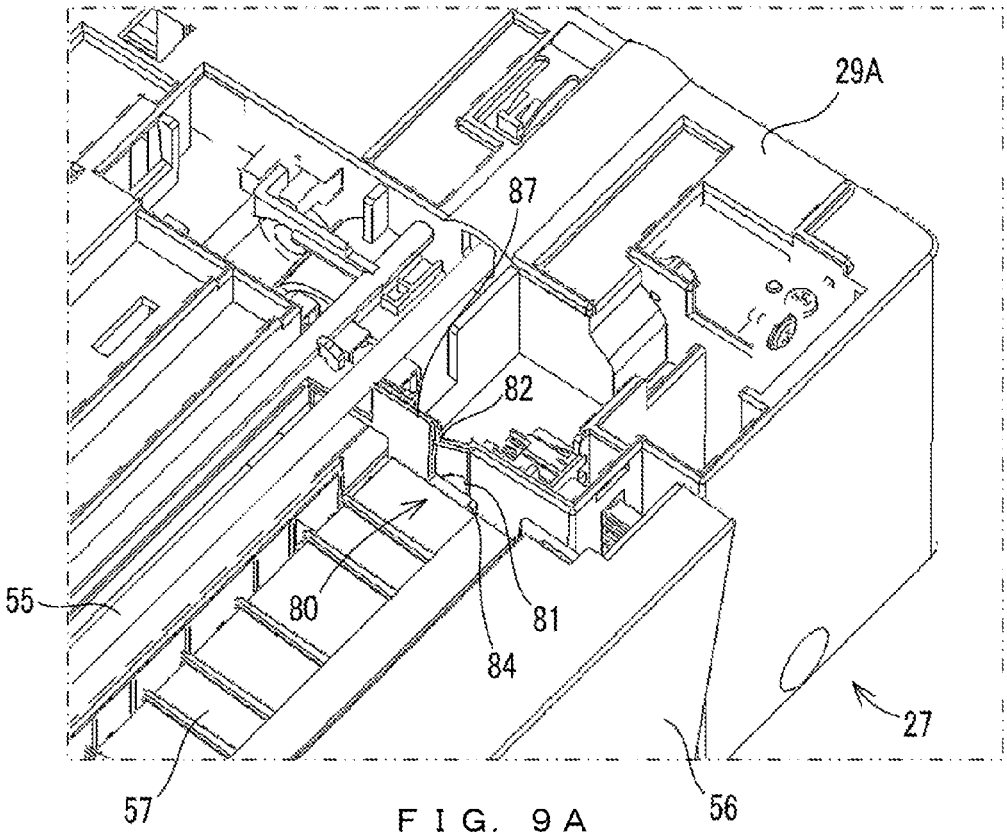
FIGS. 9A and 9B are perspective views for an explanation of operations of the lock mechanism of FIG. 8.
Figure 9B:
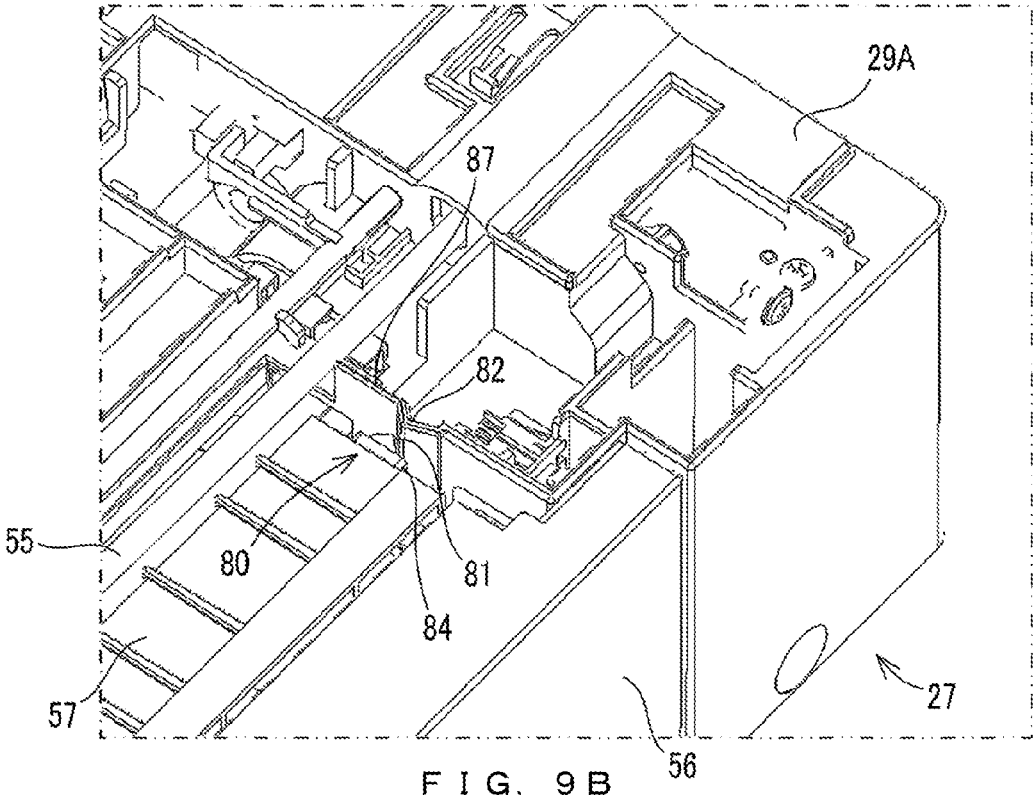

As shown in FIGS. 8 through 9B, each lock mechanism 80 includes a locking member 81 (an example of the engaging projection of the present disclosure) of a protruding shape and a locked member 82 (an example of the engaged projection of the present disclosure).

The locking members 81 are provided respectively at both ends of the inside cover 57 in the front-rear direction 7. The locking members 81 are projecting outward from both ends, and when the inside cover 57 is at the closing position, are projecting toward vertical walls 87 which are described below. Specifically, a supporting portion 84 that supports a base end 83 (see FIG. 10) of the locking member 81 is provided at both ends of the inside cover 57. The supporting portion 84 supports the locking member 81 in such a manner that the locking member 81 can move in the supporting portion 84 in the front-rear direction 7. With the base end 83 being supported by the supporting portion 84, the locking member 81 can be displaced between a predetermined retreat position and a projection position along the projecting direction. The retreat position is a position that is set inside the supporting portion 84, and the projection position is a position spaced from the retreat position outward in the projecting direction. In the present embodiment, the supporting portion 84 is formed in an approximate shape of a rectangle, and an elastic member 86 such as a coil spring (see FIG. 10) is provided inside the supporting portion 84. By the elastic force of the elastic member 86, the locking member 81 is always biased in a direction of being displaced from the retreat position to the projection position. It is noted that the elastic supporting portion of the present disclosure is realized by the supporting portion 84 and the elastic member 86.

The housing 29A is provided with two locked members 82 in correspondence with the two locking members 81. The locked members 82 are provided in the vertical walls 87 that are inner wall surfaces of the housing 29A. The locked members 82 have shapes that are projecting toward both ends of the inside cover 57 at the closing position. The locked members 82 are integrally formed with the vertical walls 87 that face the locking members 81 when the inside cover 57 is at the closing position. In other words, the locking members 81 are provided in the surfaces of both ends of the inside cover 57 that face the locked members 82 when the inside cover 57 is at the closing position. The locked members 82 are formed as projections projecting in a mountain fold shape from the vertical walls 87.

Figure 10:
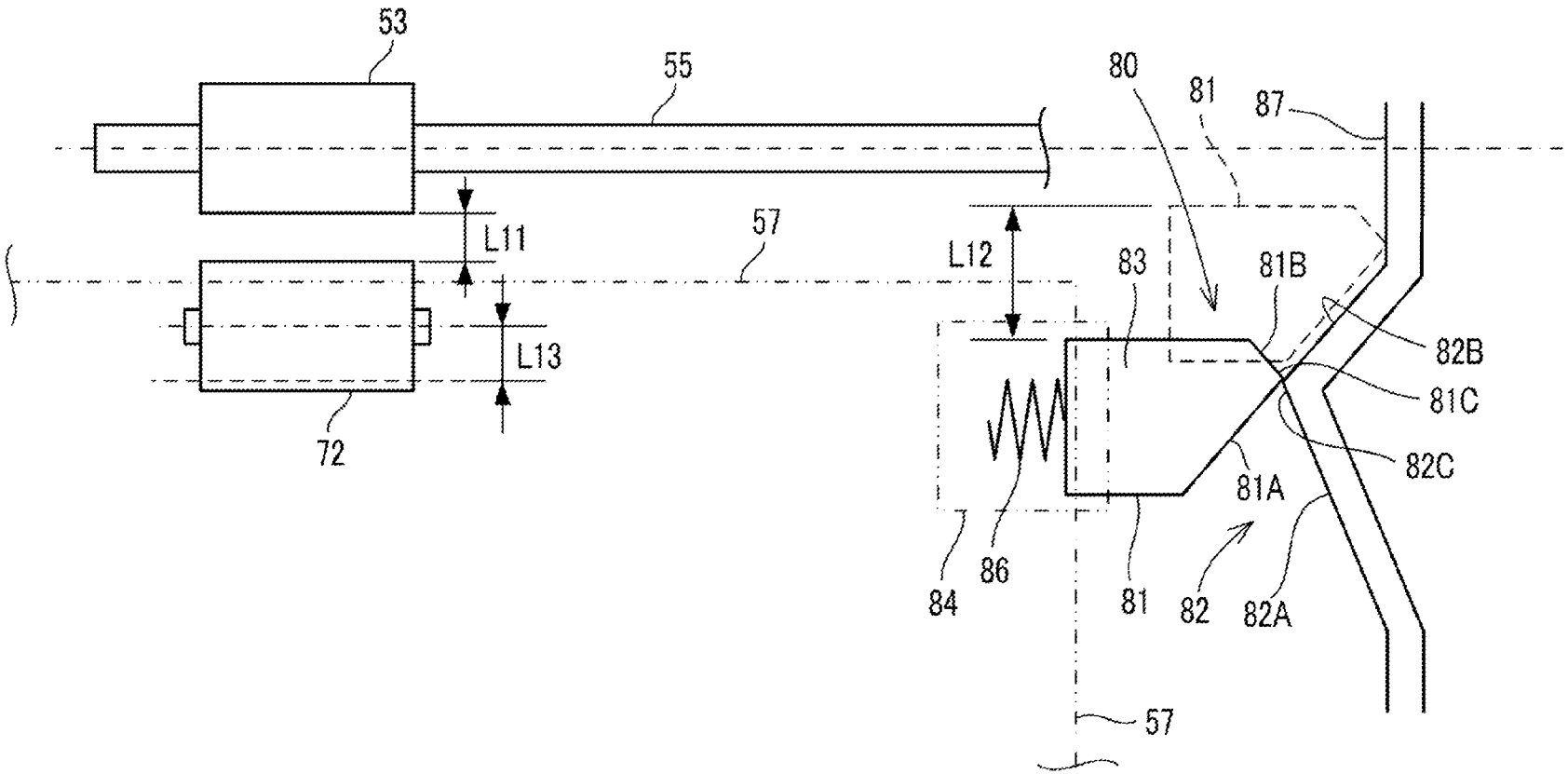
FIG. 10 is a schematic view showing the positional relation between the lock mechanism of FIG. 8 and the rotary bodies of the inside cover.

As shown in FIG. 10, each locked member 82 has an apex 82C (an example of the first apex of the present disclosure) at a position that is farthest from the vertical wall 87. The apex 82C is in a form of a projection from the vertical wall 87 and in a shape of a ridge extending in the up-down direction 6. Each locked member 82 includes a first inclined surface 82A and a second inclined surface 82B. In each locked member 82, the first inclined surface 82A is formed on the right side of the apex 82C, and the second inclined surface 82B is formed on the left side (the second conveyance path 26B side) of the apex 82C. The first inclined surface 82A is an inclined surface inclined downward from the apex 82C toward the opening position of the inside cover 57. The second inclined surface 82B is an inclined surface inclined downward from the apex 82C along the closing direction in which the inside cover 57 is moved from the opening position to the closing position. The apex 82C is formed from the first inclined surface 82A and the second inclined surface 82B.

Each locked member 82 is formed in such a manner that the inclination angle of the first inclined surface 82A is smaller than the inclination angle of the second inclined surface 82B. That is, the first inclined surface 82A has a gentler inclination than the second inclined surface 82B.

In the present embodiment, when the inside cover 57 is rotationally moved in the closing direction from the opening position to the closing position, the first inclined surface 82A contacts and presses the locking member 81 toward the retreat position. That is, the first inclined surface 82A is disposed at such a position where it contacts and presses the locking member 81 toward the retreat position. In addition, when the inside cover 57 is further rotationally moved in the closing direction toward the closing position, the second inclined surface 82B allows the locking member 81 to project toward the projection position.

As shown in FIG. 10, each locking member 81 has protrusions 81C (an example of the second apex of the present disclosure), which can contact the locked member 82, at an end thereof on the projection side (at the projection end). Each protrusion 81C is in a form of a projection projecting from the supporting portion 84 in the projecting direction of the locking member 81. Each locking member 81 includes third inclined surfaces 81A and fourth inclined surfaces 81B. In each locking member 81, the third inclined surfaces 81A are formed on the right side of (below, in FIG. 10) the protrusions 81C, and the fourth inclined surfaces 81B are formed on the left side of (above, in FIG. 10, and on the second conveyance path 26B side of) the protrusions 81C. The third inclined surfaces 81A are inclined surfaces inclined downward from the protrusions 81C toward the opening position of the inside cover 57. The fourth inclined surfaces 81B are inclined surfaces inclined downward from the protrusions 81C along the closing direction in which the inside cover 57 is moved from the opening position to the closing position. The protrusions 81C are formed from the third inclined surfaces 81A and the fourth inclined surfaces 81B.

When the inside cover 57 is at the closing position, the protrusions 81C are disposed more on the closing position side, namely more on the second conveyance path 26B side, than the center of the locking member 81 in the width direction of the locking member 81. In other words, when the inside cover 57 is at the closing position, the protrusions 81C are disposed at a position more on the conveying rollers 53 side than the center of the locking member 81.

As shown in FIG. 6A, the locking member 81 includes three protrusions 81C. When the inside cover 57 is at the closing position, these protrusions 81C are disposed at equal intervals in the extension direction of the second conveyance path 26B, namely in the up-down direction 6. This allows for the protrusions 81C to contact the locked member 82.

With respect to the lock mechanisms 80 configured as described above, in the present embodiment, the conveying rollers 53 and the driven rollers 72 are positioned to satisfy the following conditions. That is, the driven rollers 72 are positioned such that, while the protrusions 81C abut and are placed on the first inclined surface 82A, the driven rollers 72 are in no contact with the conveying rollers 53. In addition, the driven rollers 72 are positioned such that, while the protrusions 81C having climbed over the apex 82C abut and are placed on the second inclined surface 82B, the driven rollers 72 are in contact with the conveying rollers 53. Specifically, as shown in FIG. 10, the driven rollers 72 are positioned such that, in the state where the protrusions 81C are facing the apex 82C, the driven rollers 72 are separated from the conveying rollers 53 by a length L11. The length L11 is in the range from 1.0 mm to 2.5 mm, and preferably set to approximately 1.2 mm. Here, let L13 denote a press-in amount by which the driven rollers 72 are pressed into the driven rollers 72 from the position where the driven rollers 72 start contacting the conveying rollers 53, and let L12 denote a length between the position where the protrusions 81C are facing the apex 82C and the position (the lock position where the protrusions 81C are engaged with the locked members 82) where the protrusions 81C having climbed over the apex 82C are placed when the inside cover 57 is at the closing position, then the press-in amount is represented by the following equation (1).

$$L13=L12-L11 \quad (1)$$

According to the present embodiment, for example, when length L11 is set to 1.2 mm, length L12 is set to 2.9 mm, and in this case, press-in amount L13 is set to 1.7 mm.

With the above-described configuration of the lock mechanisms 80, when the inside cover 57 is moved in the closing direction in conjunction with the rotational movement of the outside cover 56 in the closing direction, the locking members 81 abut the locked members 82. During this closing process of the inside cover 57, the protrusions 81C of the locking member 81 move along the first inclined surface 82A of the locked member 82 toward the apex 82C. In this process of the movement, while the locking member 81 is displaced from the projection position to the retreat position, the protrusions 81C of the locking member 81 climb over the apex 82C of the locked member 82. Before the protrusions 81C climb over the apex 82C, the driven rollers 72 are in no contact with the conveying rollers 53 due to the above-described setting of the press-in amount L13. That is, the protrusions 81C of the locking member 81 climb over the apex 82C of the locked member 82 before the driven rollers 72 start contacting the conveying rollers 53.

When the inside cover 57 is further moved in the closing direction and the protrusions 81C having climbed over the apex 82C move along the second inclined surface 82B, the locking members 81 are displaced from the retreat position to the projection position. The locking members 81 finally stop at the lock position (the position indicated by the broken line in FIG. 10) where the inside cover 57 is locked at the closing position. The driven rollers 72 contact the conveying rollers 53 at any point within a period after the protrusions 81C climb over the apex 82C and before the protrusions 81C reach the lock position corresponding to the closing position. With such an operation of the lock mechanisms 80, the locking by the lock mechanisms 80 is ensured without the influence of the repulsive force that is generated when the driven rollers 72 contact the conveying rollers 53.

Furthermore, when the inside cover 57 is at the closing position, the protrusions 81C are disposed more on the second conveyance path 26B side than the center of the supporting portion 84. As a result, compared with the case where the protrusions 81C are disposed at the center, the locking member 81 can climb over the apex 82C at an earlier timing during the closing process in which the inside cover 57 is operated in the closing direction (closing operation). In other words, compared with the case where the protrusions 81C are disposed at the center, the protrusions 81C of the locking member 81 can climb over the apex 82C with a smaller press-in amount L13. In this way, by only disposing the protrusions 81C more on the second conveyance path 26B side than conventional ones, it is possible to ensure the locking by the lock mechanisms 80, without changing other configurations.

In addition, with the above-described configuration, it is possible to ensure a sufficient movement amount L12, wherein the movement amount L12 represents an amount of movement of the protrusions 81C, after climbing over the apex 82C, to the lock position. This makes it possible to set the length L11 to a sufficient length by taking account of shape errors and/or deformation of the inside cover 57, the housing 29A, and the like. As a result, the locking by the lock mechanisms 80 is ensured without the influence of the repulsive force even if a shape error or a deformation has occurred to the inside cover 57, the housing 29A, or the like.

According to the above-described embodiment, the locking members 81 are configured to be displaced between the retreat position and the projection position. However, not limited to this configuration, the locked members 82 may be configured to be displaced between the retreat position and the projection position.

In addition, in the above-described embodiment, the lock mechanisms 80 applied to the inside cover 57 of the sheet feed device 27 are described as an example. However, not limited to this, the lock mechanisms 80 may be applied to the inside cover 59 of the sheet feed device 28.

In addition, in the above-described embodiment, a configuration including the outside cover 56 and the inside cover 57 is explained as an example. However, the present disclosure is not limited to this configuration. For example, in a configuration where a cover (the opening/closing member) is provided to expose and close a conveyance path formed inside the apparatus main body, the lock mechanism 80 can be applied as a mechanism for locking the cover.

Furthermore, in the above-described embodiment, the lock mechanisms 80 applied to the inside cover 57 of the sheet feed device 27 are explained as an example. However, the lock mechanisms 80 are not limited by the shape of the opening/closing member or the shape or position of the conveyance path. The lock mechanisms 80 are applicable to various opening/closing members that expose and close a conveyance path in which sheet members such as print sheets are conveyed.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

a device main body including, inside thereof, a first conveying roller;

an opening/closing member supported by a side of the device main body so as to be openable and closable with one end of the opening/closing member as a fulcrum, the opening/closing member including a second conveying roller which forms a pair of conveying rollers together with the first conveying roller while abutting the first conveying roller when the opening/closing member is at a closing position with respect to the side, the opening/closing member, at the closing position, constituting a conveying guide of a conveyance path in which a sheet member is conveyed; and a lock mechanism configured to lock the opening/closing member, at the closing position, to the device main body, the lock mechanism including:

an engaged projection provided on an inner wall surface of the device main body, the inner wall surface being perpendicular to the side, the engaged projection projecting toward a facing surface of the opening/closing member that faces the inner wall surface when the opening/closing member is at the closing position;

an engaging projection provided on the facing surface, the engaging projection projecting toward the inner wall surface and configured to engage with the engaged projection when the opening/closing member is at the closing position; and an elastic supporting portion configured to support either the engaged projection or the engaging projection in such a manner that the engaged projection or the engaging projection can be displaced between a projection position and a retreat position, the elastic supporting portion biasing the engaged projection or the engaging projection toward the projection position by an elastic force thereof, wherein during a closing process in which the opening/closing member is operated in a closing direction toward the closing position, the second conveying roller is in no contact with the first conveying roller until the engaging projection abuts the engaged projection to cause the engaged projection or the engaging projection to be retreated, and climbs over the engaged projection, and the second conveying roller contacts the first conveying roller at any point within a period after the engaging projection climbs over the engaged projection and before the engaging projection reaches the closing position, wherein the engaged projection includes a first apex, a first inclined surface, and a second inclined surface, the first apex projecting in a projecting direction of the engaged projection, the first inclined surface being inclined downward from the first apex in an opening direction toward an opening position at which the opening/closing member is opened with respect to the side, the second inclined surface being inclined downward from the first apex in the closing direction of the opening/closing member with respect to the side, the engaging projection includes a base end, at least one second apex, a third inclined surface, and a fourth inclined surface, the base end being provided on the facing surface, the at least one second apex projecting in a projecting direction of the engaging projection from the base end, the third inclined surface being inclined downward from the at least one second apex in the opening direction, the fourth inclined surface being inclined downward from the at least one second apex in the closing direction, and during the closing process, the at least one second apex of the engaging projection moves along the first inclined surface toward the first apex, thereby causing the engaging projection or the engaged projection to be displaced from the projection position to the retreat position, and the at least one second apex of the engaging projection climbs over the first apex and moves along the second inclined surface, thereby causing the engaging projection or the engaged projection to be displaced from the retreat position to the projection position and causing the opening/closing member to be locked at the closing position.

2. The sheet conveying device according to claim 1, wherein the at least one second apex is a plurality of second apexes that are disposed at predetermined intervals on the base end in an extension direction of the conveyance path when the opening/closing member is at the closing position.

3. The sheet conveying device according to claim 1, wherein the at least one second apex is provided more on the second conveying roller side than a center of the base end in width direction of the base end.

4. The sheet conveying device according to claim 1, wherein an inclination angle of the first inclined surface is smaller than an inclination angle of the second inclined surface.

5. The sheet conveying device according to claim 1, wherein the opening/closing member being at the closing position constitutes the conveyance guide of the conveyance path that extend in vertical direction.

6. The sheet conveying device according to claim 1 further comprising:

an outside cover supported by the side of the device main body so as to be openable and closable with a lower end of the outside cover as a fulcrum; and an interlocking member configured to cause the outside cover and the opening/closing member to be opened and closed in conjunction with each other, wherein the opening/closing member is disposed more inside of the device main body than the outside cover and is supported inside the device main body with a lower end thereof as a fulcrum so as to be openable and closable with respect to the conveyance path in the device main body.

7. An image forming apparatus comprising the sheet conveying device according to claim 1.

* * * * *